United States Patent [19]

Kurherr

[11] 4,432,333

[45] Feb. 21, 1984

[54] ELECTROMAGNETIC PROJECTILE ACCELERATOR

[76] Inventor: Waldemar H. Kurherr, Heerdter Landstr. 201, D-4000 Duesseldorf 11, Fed. Rep. of Germany

[21] Appl. No.: 833,131

[22] Filed: Nov. 11, 1977

[51] Int. Cl.[3] ..... F41F 1/02

[52] U.S. Cl. ..... 124/3; 89/8

[58] Field of Search ..... 89/8; 124/3; 310/10

[56] References Cited

U.S. PATENT DOCUMENTS

| | | | |
|---|---|---|---|
| 754,637 | 3/1904 | Birkeland | 124/3 |
| 1,241,333 | 9/1917 | Bowman | 89/8 |
| 1,985,254 | 12/1934 | Huse | 89/8 |
| 2,783,684 | 3/1957 | Yoler | 89/8 |
| 2,870,675 | 1/1959 | Salisbury | 89/8 |

FOREIGN PATENT DOCUMENTS

| | | | |
|---|---|---|---|
| 1903959 | 8/1970 | Fed. Rep. of Germany | 89/8 |
| 448496 | 6/1936 | United Kingdom | 89/8 |

OTHER PUBLICATIONS

The Acceleration of Macroparticles and a Hypervelocity Electromagnetic Accelerator (3772) Barber, pp. 90–107, Australian National University, Canberra.

"Proceedings of 2nd Hypervelocity Symposium," vol. 1, (1957), pp. 127–141, Miller et al.

"Proceedings of 3rd Hypervelocity Symposium," vol. 1 (1959), pp. 482, 483, 553, Salisbury.

"Proceedings of 3rd Symposium on Hypervelocity" (2/59), pp. 475–484, Wengersten, pp. 553–557 Salisbury.

*Primary Examiner*—Sal Cangialosi

*Attorney, Agent, or Firm*—Cushman, Darby & Cushman

[57] ABSTRACT

Electromagnetic projectile accelerator comprising stationary coreless coils arranged in a row thus forming a tube. On the interior wall surface of said tube electrically opposite poled plates are mounted establishing an electric field.

The magnetic projectile moving through the said electric field generates an alternating switching mode in the respective electromagnetic coils whereby the acceleration of the projectile within the tube is performed.

8 Claims, 2 Drawing Figures

ELECTROMAGNETIC PROJECTILE ACCELERATOR

BACKGROUND OF THE INVENTION

In prior art devices there is among the more significant work in this field that of Fouchon-Villiphi (1922), who patented specific designs of projectiles to be used in a dc gun, Northrup (1913), who outlined a tentative design for an electromagnetic spacecraft launcher, Haensler (1942) in Germany who did extensive expermentation on a dc gun to supplant the conventional 88 mm antiaircraft gun, Muck (1942) proposed a probably technically unsound mammoth rocked launcher, the RAE at Farnborough as well as the Japanese built partially successful launcher. In the U.S. there has been extensive work done which is summerized in the publications "Proceedings of the second and third Hypervelocity and Impact Effects Symposium" sponsored by the U.S. Naval Research Laboratory and the Air Research and Development Command. The summerized study shows that primarily only three basic types, the induction, repulsion and the so-called dc or parallel rail gun were functionable. All three types function on the same basic principle that into the coils or rails, a polyphased ac or dc pulsed current of varying frequency from a few cycles to several hundred kilocycles/sec is fed. This moving magnetic flux field sweeps over the projectile inducing currents within it and thereby dragging it along at a certain rate of acceleration.

1960–62 Work in the U.S. on the said electromagnetic accelerators was abandoned mainly due to such negative features as: arcing, eddy currents, high inductions in coils and projectiles causing deformation and melting. The present invention relates to an electromagnetic projectile accelerator without those negative features thus rendering possible the technical realisation of a very useful scientific research instrument for hypervelocity and simulated meteor impact studies as well as on a grander scale for technological space application.

SUMMARY OF THE INVENTION

The object of this invention is to show an electromagnetic projectile accelerator where the projectile is mainly accelerated by electromagnetic attraction thus omitting heating and deformation due to induced currents as must naturally accur with electromagnetic accelerators based on the principle of magnetic induction.

It is further the aim of this Invention to show an instrument designed for hypervelocity experiments of high scientific accuracy, enabling the scientist to present and reproduce an experiment or to alter the acceleration or deceleration as desired preferably under vacuum condition so that the projectile will not get contaminated with foreign gas particles.

A further aim of this invention is to produce a second stage electromagnetic accelerator or decelerator, meaning that, from any exterior type of accelerator a projectile can be shot into the present electromagnetic accelerator to be further accelerated or decelerated and thereby captured without deformation.

Another aim of this invention is to show a large scale electromagnetic accelerator for such space technology application as acceleration of large space vehicles carrying radioactive waste material to escape velocities thus render possible their ejection into the sun.

Furthermore it is the object of this invention to indicate the economical advantages of the present invention compared to the former inductive electromagnetic accelerators needing expensive phase and pulse generators, control units, high voltage transformers, high voltage capacitors, intricate switching, timing and computing devices whereas for the present invention only a dc current suffices whereby the switching etc. is being done by the accelerating projectile.

The objects of the invention have been attained by constructing a electromagnetic projectile accelerator comprising stationary coreless electromagnetic coils arranged in a row whereby the space between the said coils is sealed by electrically and magnetically nonconductive rigid spacer rings so that a solid tube is constructed.

The exterior wall surface of said tube encompasses a ferromagnetic tube to enhance and conduct the magnetic flux of said stationary electromagnetic coils.

On the interior wall surface of said tube electrically insulated upper and lower electrically opposite poled plates are mounted in a row.

A free floating projectile comprising a magnetically and preferably electrically nonconductive body with electromagnetic coils and cores disposed rigidly within the body spaced in a row. Each coil is electrically connected to exterior on the upper and on the lower part of the body mounted electric conductors. The Conductors are spring suspended with a surface part composed of an electrically conductive, high temperature- and abrasionproof material.

The stationary coils are energized by a dc electric current in such a way that the said coils face each other with opposing magnetic poles. Also the electric upper and lower electric plates are circulated in such a way that the upper plate has the opposite electric polarity to the lower plate and also the opposite electrical polarity to the plates before and behind it.

The projectile moves through the accelerating tube without contacting the interior wall surface of the tube. This free floating effect is attained due to the fact that the stationary coils magnetically attract the projectile to the center axis of the coils where the highest magnetic flux density predominates.

As the electric conductors enter the electric field of the upper and lower electric plate arcing occurs and the electric current is led from one conductor via the respective electromagnetic coil within the hull and out through the other conductor into the opposite electric plate, thus the coils within the hull of the projectile are alternatingly energized with a respective magnetic polarity and thereby magnetically attracted to the corresponding stationary coils. Inside the stationary coils where the attractive magnetic force is minimal the coils of the projectile are deenergized.

As the coils of the projectile move out of their respective stationary coils the total built-up of the repulsive magnetic field in the projectile coil is prolonged so that the attractive magnetic force which centers the projectile on the center axis of the stationary coil prevails.

The great advantage of this invention is that once the stationary coils and the electric plates are energized by a simple dc current the switching at the most optimal rate is accomplished without any exterior aid by the free floating projectile itself. The dc voltage depends an the state of vacuum in the tube and the distance of the electric plates to the conductors.

To use this electromagnetic projectile accelerator to eject e.g. radioactive waste material into the sun, or parts of a to be build space station into orbit should be closely examined. The inside diameter should then be 2 to 3 meter and several kilometer in length. The tubes air should be exhausted having a plastic cap at the end which the projectile would break through. To prevent the whole tube to be refilled by air some hundred meters from the top a closing port should be situated.

For the transportation of passengers or goods that do not withstand a high acceleration an auxiliary propulsion unit can be used as second or third rocked stage.

The application of a superconducting magnet in the projectile as a additional heat shield would produce a floating shock barrier without physical contact, also as a passband (magnetic window) for communication blackout control or proton radiation shielding weighing approx. 1/100 of comparable passive shielding. Such projectiles consisting of only the hull and coils and no instrumentation could be launched in any weather directly into a predetermined orbit. The electrical energy for those few seconds can easely be supplied by a M.H.G.-Generator.

As a scientific hypervelocity instrument a number of variations are possible.

To accelerate a ferromagnetic meteor simulating projectile, only the attractive magnetic force can be utilized. The free floating projectile passing through the electric field of the electric plates triggers a pulse which energizes the respective stationary coil ahead of it and desactivates the coil behind. For deceleration purposes the projectile triggers a pulse energizing the respective coil behind it thus experienceing a negative acceleration.

Coils can also be supplanted by permanent magnets or superconducting coils.

BRIEF DESCRIPTION OF THE DRAWINGS

Other and further objects of the present invention will become more apparent from the following detailed description of the various embodiments thereof when taken with reference to the appended drawings in which like characters refer to like structure and in which.

DETAILED DESCRIPTION OF A PREFERRED EMBODIMENT

Figure 1:
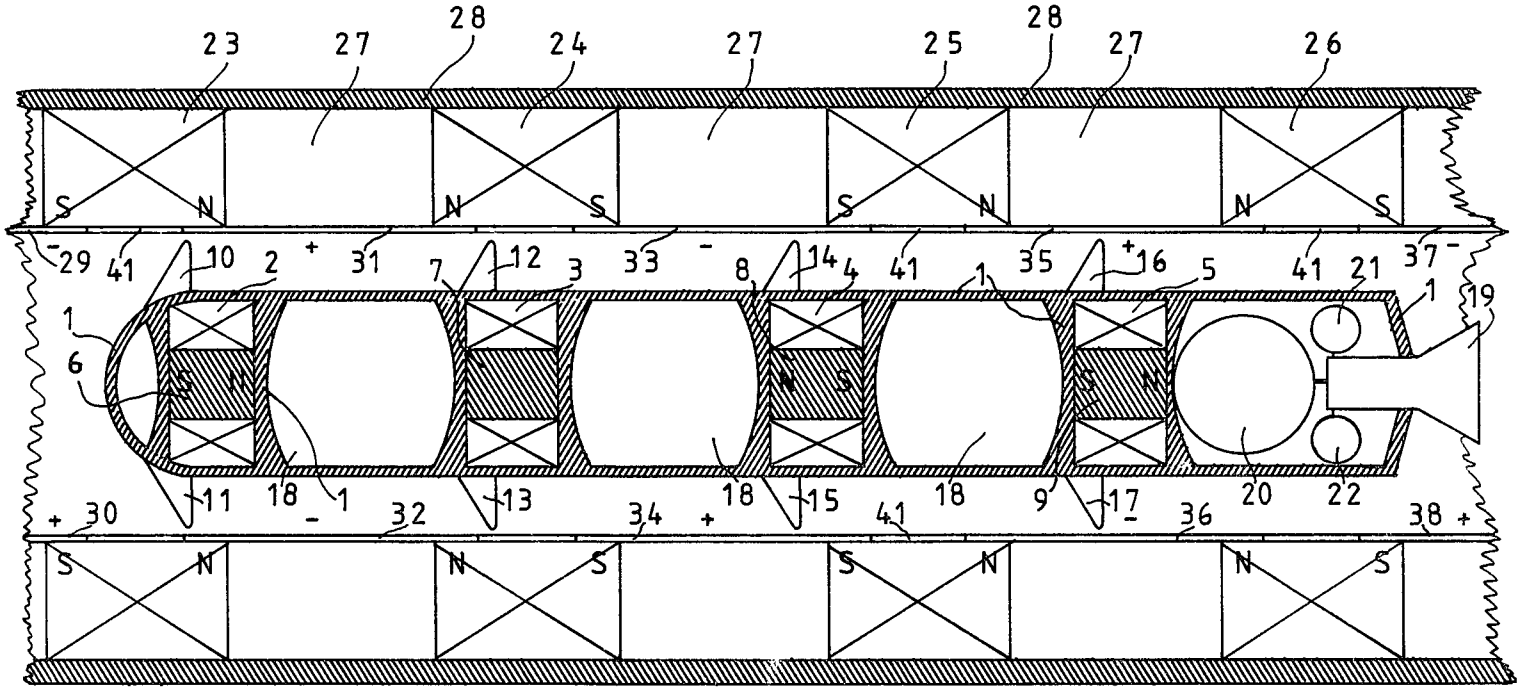
FIG. 1 shows a side sectional view of the electromagnetic projectile accelerator as well as a side sectional view of the projectile.
Figure 2:
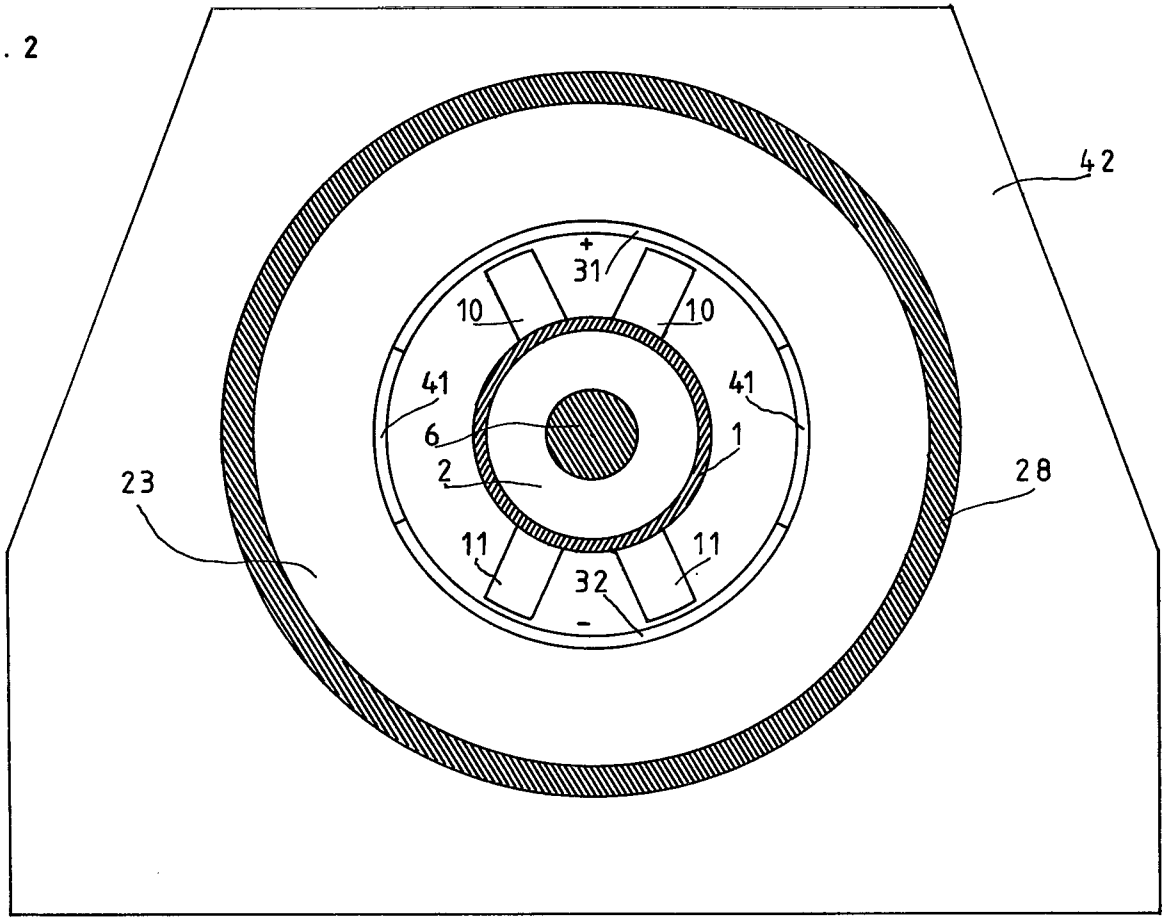
FIG. 2 shows a cross sectional view of the electromagnetic projectile accelerator and projectile.

As illustrated in FIGS. 1 and 2 a electromagnetic projectile accelerator according to the instant invention includes, the projectiles body 1 in which the electromagnetic coils 2, 3, 4 and 5 with their ferromagnetic cores 6, 7, 8 and 9 are rigidly fitted. On the exterior upper and lower surface of the projectile body 1 the conductors 10, 11, 12, 13, 14, 15, 16 and 17 are mounted and electrically connected to their respective coil. Inside the projectile body 1 cargo chambers 18 are situated. In the rear part of the projectile body 1 an auxiliary propulsion unit comprising rocked chamber 19 and fuel tanks 20, 21 and 22 are situated.

The accelerator tube comprises the stationary electromagnetic coreless coils 23, 24, 25 and 26 fitted rigidly between the electrically and magnetically nonconductive spacer rings 27. Surrounding the stationary electromagnetic coils 23, 24, 25 and 26 and the spacer rings 27 a ferromagnetic tube 28 is tightly fitted.

On the interior wall surface of the acceleration tube the respective electrically poled upper plates 29, 31, 33, 35 and 37 are mounted and on the lower interior wall surface the corresponding opposite poled electric lower plates 30, 32, 34, 36 and 38 are mounted. Between the upper and lower said plates the insulating plate 41 is fitted.

In FIG. 2 a concrete encasing 42 is shown in which the accelerator tube is structurally anchored. The coils should preferably contain tape windings to bear higher pressures.

FIG. 1 shows further the working procedure of the electromagnetic projectile accelerator whereby the electromagnetic coil 2 is energized by an electric current arcing from the upper electrically positive poled plate 31 over the conductor 10 through coil 2 thus generating a magnetic south pole in the front and a magnetic north pole in the rear of said coil 2 thereby leaving over the conductor 11 via arcing to the electrically negative poled plate 32.

The magnetic south pole of said coil 2 is thereby being magnetically attracted towards the center axis of the magnetic noth pole of the stationary coil 23. The conductors 12 and 13 of coil 3 are shown in the vicinity of the electrically neutral insulating plate 41 therefore no electric current is conducted and coil 3 is deenergized.

The electromagnetic coil 4 is energized from the positive poled plate 34 by arcing over to the conductor 15 through the coil 4 to conductor 14 and via arcing out to the electrically negative poled plate 33 thus generating a magnetic north pole in front and a magnetic south pole in the rear of coil 4, whereby coil 4 experiences a magnetic repulsive force from the magnetic south pole of the stationary coil 25 and a magnetic attractive force towards the magnetic south pole of the stationary coil 24.

The electromagnetic coil 5 of the projectile experiences the same magnetic forces as coil 4 although oppositely circuited.

Due to the fact that the magnetic attractive force is predominant the projectile centers within the highest magnetic flux density on the magnetic center axis of the stationary coils 23, 24, 25 and 26 and does therefore not touch the interior wall surface of the acceleration tube whereby sliding friction is prevented. Contrary to acceleration devices where the attainment of extreme high velocities of the projectile is limited by guiding devices such as rails, wheels or sliding devices the instant invention has no such limitations.

It will be manifestly appreciated by those skilled in the art that the electromagnetic projectile accelerator according to the instant invention can be employed in various form.

It will be understood therefore that the various embodiments herewith described and disclosed have only been shown by way of example and other and further modifications of the instant invention may be made without avoiding the spirit or scope thereof.

The embodiment of the instant invention in which an exclusive property or privilege is claimed is defined as follows:

1. Electromagnetic projectile accelerator comprising: means for rigidly mounting stationary coreless electromagnetic coils spaced apart along a row, the spaces therebetween being sealed with tightly fitted electrically and magnetically nonconductive rigid spacer-rings, said coils and rings together forming an acceleration tube having exterior and interior wall surfaces, the exterior wall surface being surrounded with a ferromagnetic material, the interior wall surface consists of an electrically and magnetically nonconductive material on which wall surface a plurality of electrically conductive plates are mounted so as to be spaced apart along the interior of said tube, said plates being electrically connected and electrically isolated from each other and electrically poled opposite to each other, said stationary coils being electrically connected and energized such that the stationary coils face each other with opposing magnetic poles; free floating projectile means disposed within said acceleration tube comprising a magnetically and preferably electrically nonconductive projectile body, a plurality of electromagnetic coil means rigidly mounted in a spaced apart manner within said projectile, said electromagnetic coils including cores therein whereby said electromagnetic coils are electrically connected to conductors mounted on upper and lower exterior surfaces of the projectile body whereby electric current is conducted from at least one of said electrically positive poled plates through the respective conductor thus energizing the electrically connected electromagnetic coil within the projectile thereby leaving via arcing from the other conductor into at least one of the electrically negative poled plates, whereby consecutive alternating switching due to the forward motion of the projectile through the electric field of the alternatingly electrically poled plates a continuous acceleration of the projectile within the preferably evacuated acceleration tube is performed.

2. Electromagnetic projectile accelerator as claimed in claim 1 wherein said stationary electromagnetic coils are supplanted by permanent magnets.

3. Electromagnetic projectile accelerator as claimed in claim 1 wherein said electromagnetic coils within the projectile are supplanted by permanent magnets and whereby an electric bridging contact between the opposite electrically poled plates is established whereby the said stationary electromagnetic coils are alternatingly energized by the moving projectile.

4. Electromagnetic projectile accelerator as claimed in claim 1 wherein a ferromagnetic projectile moving through the electric fields of said opposite electrically poled plates generates an electric trigger pulse thereby consecutively switching the said stationary electromagnetic coils ahead of said projectile.

5. Electromagnetic projectile accelerator as claimed in claim 1, 2, 3 or 4 wherein said electromagnetic coils are superconductive.

6. Electromagnetic projectile accelerator as claimed in claim 1 wherein said projectile further includes auxiliary propulsion unit means for providing additional propulsion forces to said projectile.

7. Electromagnetic projectile accelerator as claimed in claim 1, 2, 3 or 4 wherein said electromagnetic coils contain tape windings.

8. Electromagnetic projectile accelerator as claimed in claim 5 wherein said electromagnetic coils contain tape windings.

* * * * *